United States Patent [19]

Shulman

[11] 4,152,879

[45] May 8, 1979

[54] SPIRAL-WRAP APPARATUS

[76] Inventor: Michael H. Shulman, 45 Bruce Farm Dr., Toronto, Ontario, Canada, M2H 1G4

[21] Appl. No.: 808,456

[22] Filed: Jun. 21, 1977

[51] Int. Cl.[2] ..... B65B 11/04

[52] U.S. Cl. ..... 53/399; 53/465; 53/211; 53/587

[58] Field of Search ..... 53/3, 30 R, 32, 184 R, 53/198 R, 211, 399, 441, 465, 556, 587; 100/13, 15, 27, 28

[56] References Cited

U.S. PATENT DOCUMENTS

| | | | |
|---|---|---|---|
| 965,317 | 7/1910 | Nyberg | 53/211 |
| 2,088,133 | 7/1937 | Evans | 100/28 |
| 2,811,916 | 11/1957 | Guilleminot et al. | 100/15 |
| 3,003,297 | 10/1961 | Broadhead et al. | 100/27 X |
| 3,370,394 | 2/1968 | Taylor | 53/211 X |
| 3,863,425 | 2/1975 | Edwards | 53/211 |
| 3,867,806 | 2/1975 | Lancaster et al. | 53/30 R X |
| 3,986,611 | 10/1976 | Dreher | 53/32 X |
| 3,994,118 | 11/1976 | Felix | 53/198 R |
| 4,077,179 | 3/1978 | Lancaster et al. | 53/184 R |

FOREIGN PATENT DOCUMENTS

| | | | |
|---|---|---|---|
| 2303590 | 8/1973 | Fed. Rep. of Germany | 53/210 |
| 2256871 | 8/1975 | France | 53/32 |

OTHER PUBLICATIONS

"Stretch-Film Unitizing" by G. V. Schultz, Dec., 1973 - Factory.

*Primary Examiner*—John Sipos

[57] ABSTRACT

An improvement is disclosed in wrapping apparatus for palletized loads of the kind having a rotatable platform where the load is received, and a roll of plastic film mounted adjacent to the platform for vertical movement so that plastic film can be dispensed onto the load while the platform rotates, in order to enwrap the load helically. The improvement is the provision of an elongated roller member pivoted adjacent one of its ends to the platform so that is can swing between two positions through an arc in a vertical plane. In the first position the member bears against a frictional surface on the platform, and in the second position it is spaced from the frictional surface. In swinging from the second to the first position at the end of a wrapping operation, the elongated roller member catches the film and pinches it between itself and the frictional surface. A hot-wire severing means mounted adjacent to the frictional surface on the platform severs the film so that the first palletized load can be removed and a next load placed on the platform.

10 Claims, 4 Drawing Figures

SPIRAL-WRAP APPARATUS

This invention relates generally to apparatus for spirally-enwrapping a palletized load with stretchable plastic film, and has to do particularly with an apparatus adapted to wrap the load in a helical configuration with a web of plastic film having a width smaller than the height of the load.

It is known to provide a spiral-wrap apparatus for palletized loads, in which a rotatable platform is situated horizontally for receiving the palletized load, and in which a means for dispensing film adjacent the platform typically includes a vertical mandrel on which a spool of suitable stretchable film can be disposed. The kind of apparatus to which this invention particularly pertains is that in which the width of the film is smaller than the height of the load to be wrapped, and in which the mandrel supporting the spool of film is located on a carriage assembly which is adapted to be raised and lowered in the vertical direction while the wrapping is proceeding. Thus, mechanical means are provided in the apparatus for simultaneously rotating the platform while at the same time causing the spool of film on its carriage to move vertically upwardly and then downwardly, thereby to enwrap the load in a helical pattern.

It should be pointed out that, in the trade, it is customary to use the expression "spiral-wrap" when referring to this operation, which, strictly speaking, is one of helical wrapping. In the appended claims, the correct word "helical" is utilized wherever appropriate.

Many of these wrapping apparatuses are used in combination with conveyor means adapted to feed sequential loads onto the rotatable platform, where the load is wrapped in the wrapping operation, and then for feeding the wrapped load further along in the same direction to remove it from the rotatable platform. Simultaneously, the next sequential load would come into place on the platform. Typical of such assemblies is one in which the conveyor means consists of a roller track having transverse rollers mounted between two parallel, spaced-apart frame members. On the rotatable platform of the wrapping apparatus, there is provided a "continuation" of the roller means, so that, when the platform roller means and the conveyor roller means are in proper alignment, a palletized load can be shifted directly from the conveyor roller means onto the platform.

In the operation of this known wrapping apparatus, at least one operator must be present to manually cut the film at the end of each wrapping operation for a given palletized load, and to "tuck" the free end under one of the convolutions or otherwise adhere the free end to the completed load.

The operator is also required to start the wrapping operation, which typically commences with the operator pulling the leading end of the stretchable film from the roll and tucking it into the load, for example between stacked boxes or packages, so that when the platform begins to rotate the leading end can be pulled away from the roll of film. In other words, an initial contact or attachment of the leading end of the film to the load must be made, before the wrapping can be initiated.

It would be of advantage to provide an apparatus capable of performing both of these steps automatically, without requiring the help of an operator, and it is with this advantage in mind that the present invention has been developed.

Accordingly, this invention provides, in a wrapping apparatus for a palletized load having a rotatable platform for receiving the load, film-dispensing means adjacent the platform for receiving a roll of film of a width less than the height of the load, and means for rotating the platform while moving the film-dispensing means vertically in order to enwrap the load helically, the improvement which comprises:

an elongated member pivoted adjacent one end to the platform for swinging movement between first and second substantially horizontal positions through an arc of about 180° in a vertical plane substantially aligned with a side of the load, the member in said first position being below the level of the bottom of the load and bearing against a frictional surface supported by the platform, and in said second position being spaced away from said frictional surface, means for swinging the member between said positions to contact said film across substantially the full film width and to pull the film down below the level of the bottom of the load, and automatic severing means on the platform adjacent the frictional surface for severing film.

This invention also provides a method of wrapping a palletized load on a wrapping apparatus having a rotatable platform for receiving the load, film dispensing means adjacent the platform for receiving a roll of film, and means for rotating the platform while moving the film-dispensing means vertically in order to enwrap the load helically, comprising the steps:

(a) providing an elongated member pivoted adjacent one end to the platform for swinging movement adjacent a side of the load, (b) providing a substantially horizontal frictional surface on the platform, against which the elongated member in one position can bear, (c) providing automatic film severing means on the platform adjacent the frictional surface, (d) gripping an end of the film between the elongated member and the frictional surface, (e) rotating the platform while simultaneously moving the film-dispensing means vertically upwardly and then downwardly through at least one up and down cycle, thereby to enwrap the load helically, and during said at least one cycle swinging the elongated member away from said frictional surface, (f) halting the rotation of the platform when the film-dispensing means is substantially at the bottom of its movement and with the said side of the load toward the film-dispensing means, (g) and swinging the elongated member back toward the frictional surface, thereby catching the portion of the film extending between the film-dispensing means and the load, pulling it down below the level of the bottom of the load, and entrapping it between the elongated member and the frictional surface, and (h) severing the film with severing means located on the platform adjacent the frictional surface, the severing being on the load side of the gripping location.

One embodiment of this invention is illustrated in the accompanying drawings, in which like numerals denote like parts throughout the several views, and in which.

Figure 1:
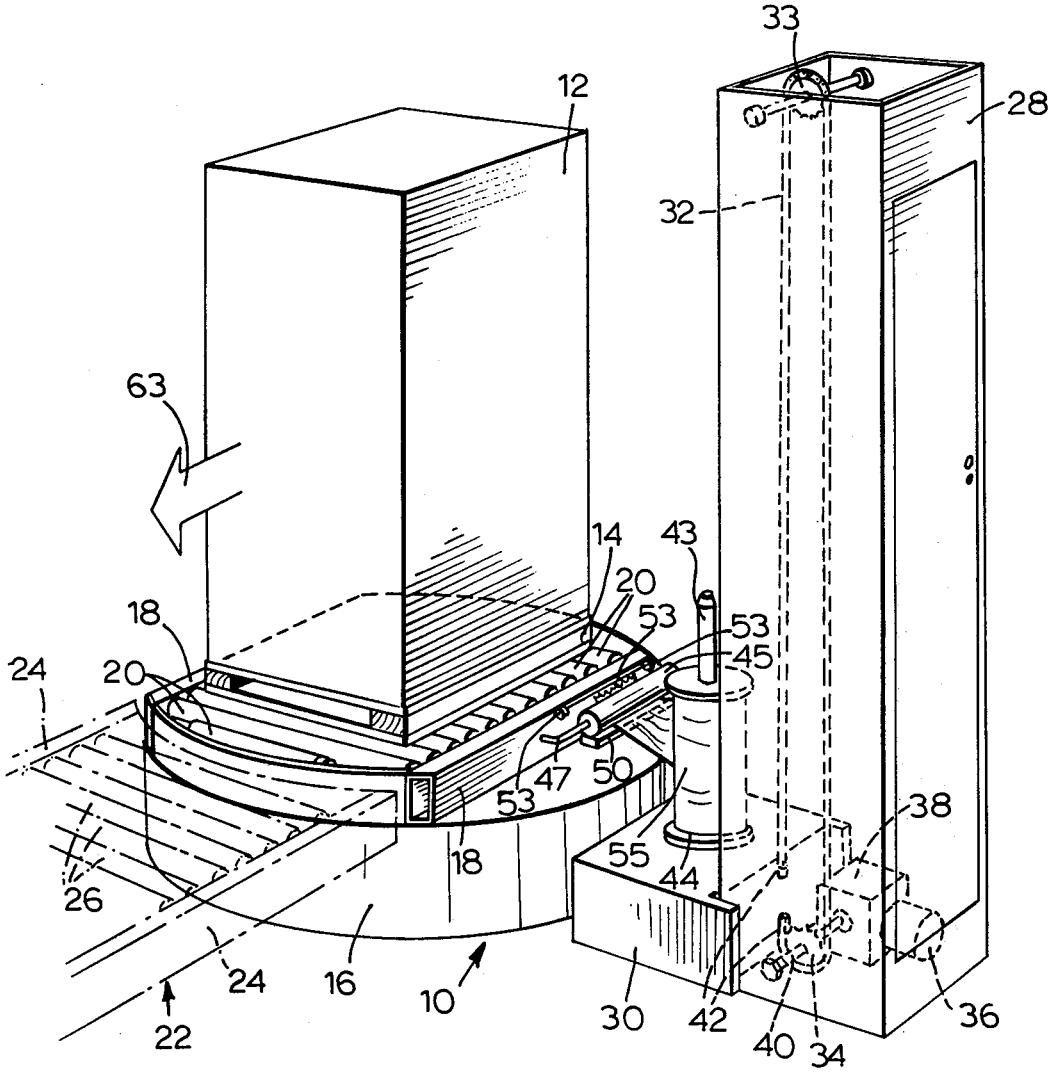
FIG. 1 is a perspective view of an apparatus constructed in accordance with this invention, showing the same at the commencement of a helical wrapping operation with a palletized load in place.

Attention is first directed to FIG. 1 which shows a wrapping apparatus 10 for a palletized load 12. The load 12 typically consists of a plurality of packages, boxes, containers or the like (not individually shown in the Figures) supported on a pallet 14.

The wrapping apparatus 10 includes a rotatable platform 16 upon which are mounted two rails 18, between which are mounted a plurality of rollers 20, some or all of which may be driven in any conventional manner. In FIG. 1 a portion of a conveyor is shown in broken lines at 22. The conveyor 22 includes two rails 24 at the same elevation as the rails 18, an spaced apart to receive a plurality of rollers 26. When the rotatable platform 16 is in the position shown in FIG. 1, the rails 18 are substantially aligned with the rails 24, and the upper surfaces of the rollers between the two sets of rails are substantially co-planar.

The apparatus 10 further includes film-dispensing means adjacent the platform 16, this means including a vertically upstanding structure 28 which is fixed with respect to the centre axis of the platform 16 by virtue of a general frame interconnecting both the platform 16 and the structure 28 (not illustrated, for the sake of simplicity). A carriage 30 is supported by the vertical structure 28 and is able to move in a vertical direction upwardly or downwardly as controlled by a chain element 32 within the structure 28 which is entrained over an upper sprocket 33 and over a lower sprocket 34 which is adapted to be driven by a motor 36 through a speed reducer 38 from which extends a shaft 40 to which the sprocket 34 is keyed. The two ends 42 of the chain 32 are secured to the carriage 30.

Extending vertically upwardly from the carriage 30 is a mandrel 43 which is adapted to receive a spool 44 containing stretchable plastic film.

The mandrel 43 is rotatable, and the connection between the spool 44 and the mandrel 43 is such that they rotate together. Braking means are provided (not shown) for applying a frictional drag or braking force on the mandrel 43 while the latter is rotating, such braking means being known per se.

In the general operation of prior apparatuses of this type, the rotatable platform 16 is rotated while the carriage 30 is gradually moved vertically upwardly along the structure 28 and then vertically downwardly. All during this vertical movement of the carriage 30, the spool 44 is dispensing stretchable film, since the latter is being pulled off the spool 44 due to the rotation of the load 12 on the platform 16. This results in a helical wrapping pattern around the load 12, having a number of layers depending upon the number of up-and-down cycles undergone by the carriage 30 during the rotation of the rotatable platform 16.

Referring still to FIG. 1, the improvement provided by this invention includes an elongated member 45 which is pivoted adjacent its nearer end in FIG. 1 to the platform 16, or more specifically in the embodiment shown to the mid-region of the rail 18. The elongated member is a cylindrical roller which is mounted for free rotation about its axis, the latter being coincident with an arm 47 which extends axially from the member 45 and then undergoes a right-angled bend to extend normally to the surface of the rail 18. The portion of the rod 47 which extends into the rail 18 defines a pivot axis for the member 45 with respect to the platform 16, the pivotal motion being best understood by glancing at FIG. 2. The rod 47 is thus journalled in suitable structure within the rail 18 (not shown), and rack-and-pinion means are provided within the rail 18 in a manner that will be evident to those skilled in the art, for causing the member 45 to pivot between the positions shown in FIG. 2 in solid lines and in broken lines.

FIG. 1 shows the member 45 in its first position, in which it bears against the frictional upper surface of a friction pad 50 which is securely mounted with respect to the platform 16. As can be seen in FIG. 1, the leading end of the stretchable film on the spool 44 is shown to be entrapped between the member 45 and the frictional surface of the friction pad 50.

Mounted also to the rail 18 toward its upper, outer edge and adjacent the friction pad 50 is a resistance wire 52 which is strung under tension between two projecting tabs 53. The resistance wire 52 can be heated by passing an electrical current therethrough, and as will be seen later, when the film bears against the wire 52 in the heated condition, it will be severed. It is to be understood that the film normally used in this application is a thermoplastic film, and thus easily severed under the application of heat.

FIG. 1 represents the condition of the apparatus just after the palletized load 12 has been slid into place from the conveyor 22, and prior to the initiation of rotation or the rotatable platform 16. The entrapment of the leading end of the film 55 between the elongated member 45 and the friction pad 50 results from an assumed previous wrapping operation. The way in which this condition comes about at the end of an operation will be understood from what follows.

Figure 2:
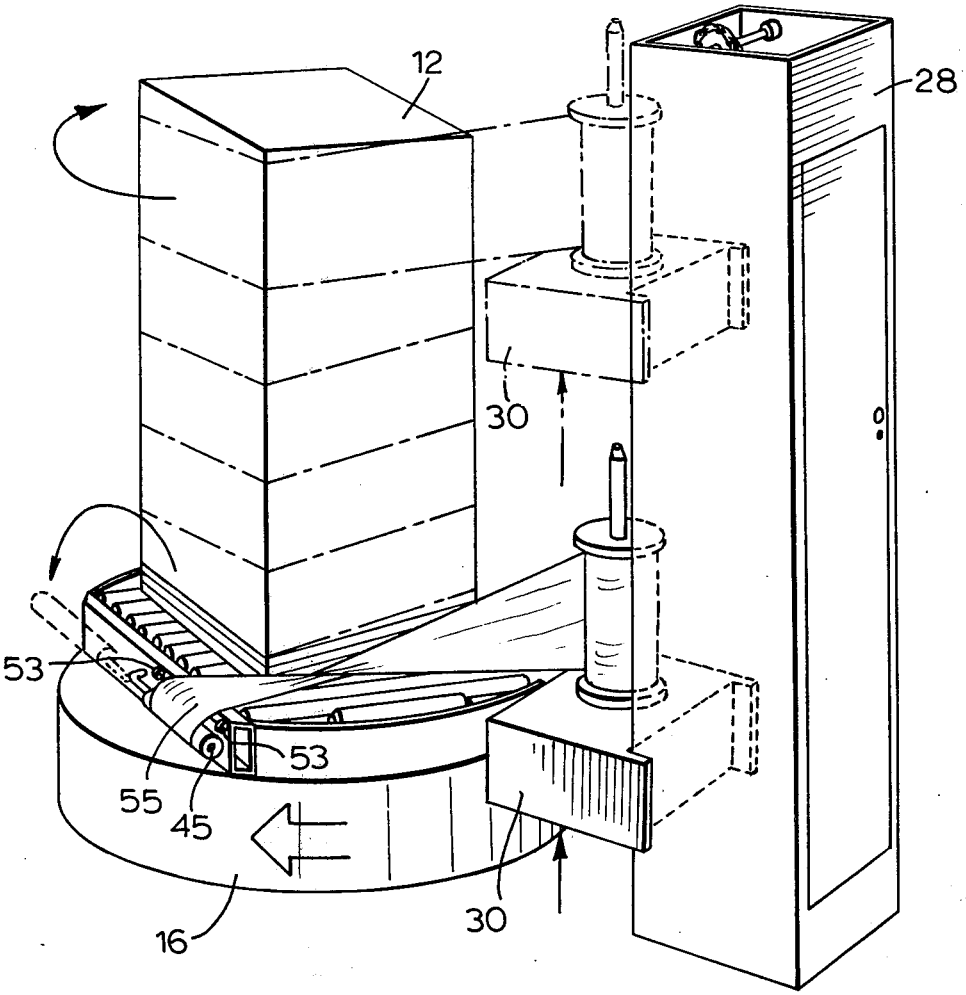
FIG. 2 is a perspective view similar to FIG. 1, showing in solid lines a first intermediate condition of the apparatus during the wrapping of the load, and in broken lines a subsequent condition of the apparatus during the wrapping operation.

Beginning then with the condition shown in FIG. 1, the rotatable platform 16 is set into rotation in the clockwise fence as seen from above, and after a rotation of just over 90°, the condition shown in solid lines in FIG. 2 will arise. In FIG. 2, the leading end of the film 55 has been pulled now to the left, and a twist has taken place in the film 55 due to this movement. From this point on, however, no further twisting will take place, and as the platform 16 continues to rotate in a clockwise sense as seen from above while the carriage 30 gradually rises vertically upwardly along the structure 28 towards the position shown in broken lines near the upper end of the structure 28, a helical wrapping process will take place in which the film 55 is gradually wrapped around the load 12. By selecting the relative speeds of rotation and of vertical assent for the platform 16 and the carriage 30 respectively, it is possible to ensure that the successive convolutions of the film 55 are in overlapping relation.

At some time during the ascending and descending cycle for the carriage 30, as the platform 16 continues to rotate, the mechanism controlling the position of the elongated member 45 is activated to rotate the member through roughly 180° to the second position for the member, which is shown in broken lines in FIG. 2. The second position is one in which the member 45 extends substantially diametrically opposite to its direction at the beginning of the wrapping procedure.

When the carriage 30 has risen to the uppermost end of its travel, it then descends back downwardly towards its initial position shown in FIG. 1. The descent of the carriage 30, while the platform 16 continues to rotate, automatically applies a second layer of helical, overlapping film convolutions to the load 12.

Figure 3:
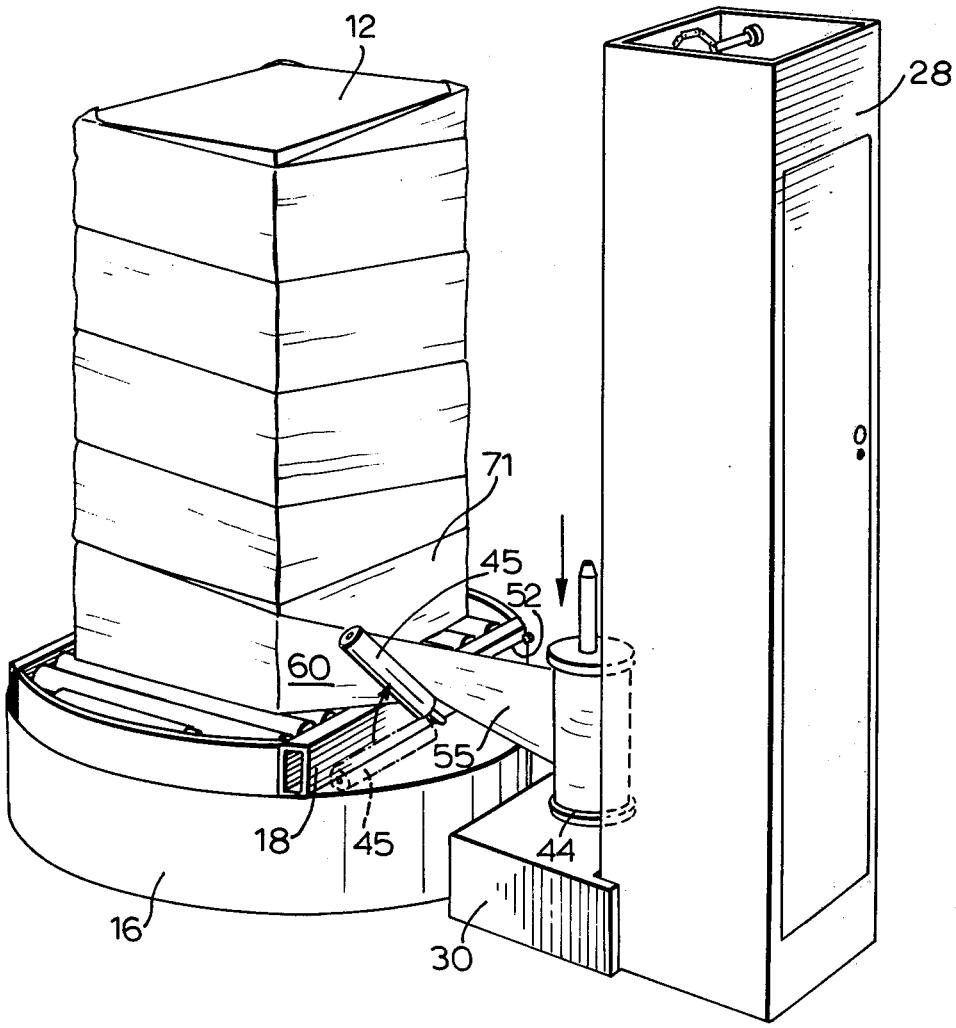
FIG. 3 shows the apparatus at the end of the wrapping and in the midst of the automatic severing operation for the stretch film.

When the carriage 30 has reached the lowermost end of its travel after the helical wrapping procedure has been completed, the condition of FIG. 3 arises. In FIG. 3, it is assumed that the carriage 30 has reached the bottom end of its travel, and that subsequently the platform 16 continues to rotate through at least one more complete revolution, in order to build up several film layers around the base of the load 12, in order to strengthen the connection between the load 12 and the pallet. After this additional strengthening wrap is completed, the platform 16 comes to a halt in a position in which the elongated member 45 is facing the structure 28. In other words, the final "halt" orientation of the platform 16 is identical to the initial orientation seen in FIG. 1.

As soon as the platform 16 comes to a halt in the condition shown in FIG. 3, the mechanism controlling the position of the elongated member 45 is again activated to move the member from its second position (shown in broken lines in FIG. 3) to its first position (shown in solid lines in FIG. 1). In FIG. 3, the solid line representation shows the elongated member 45 at an intermediate condition between the two positions, and as can be seen the member 45 has caught the portion of the film 55 which extends from the spool 44 to the load 12. Further clockwise pivoting of the member 45 from the position shown in FIG. 3 will carry that part of the film 55 rightwardly and downwardly against the upper, outer edge of the nearer rail 18 in FIG. 3, and will ultimately entrap the film between the elongated member 45 and the upper frictional surface of the friction pad 50. At the same time, the portion of the film which extends to the "load" side of the pinching location will be in pressure contact against the resistance wire 52. A switch is then thrown to allow electric current to flow through the resistance wire 52, to heat and thus sever the film 55 at that place.

The result will be that the film wrapped around the load 12 is severed from the remainder of the film, and the free edge of that remainder will be in exactly the same condition as is shown in FIG. 1.

There will be a loose "tail" of the film 55, constituted by the portion identified by the numeral 60 in FIG. 3, and this tail 60 will have to dealt with in some way in order to prevent unwrapping of the convolutions of the film from the load 12.

Figure 4:
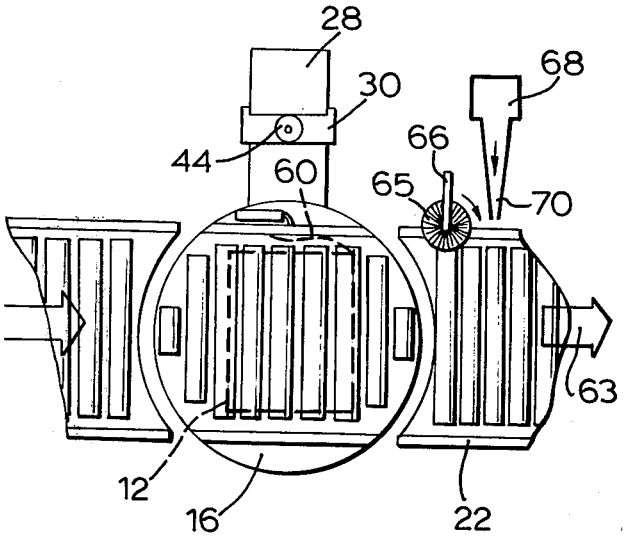
FIG. 4 is a plan view of the apparatus of FIGS. 1, 2 and 3.

FIG. 4 shows a way in which this unwrapping is prevented.

As the wrapped load 12 is moved from the rollers of the platform 16 onto rollers of the conveyor 22 along the direction shown by the arrow 63 in FIG. 1 and FIG. 4, the "tail" 60 will be trailing due to the fact that it is extending in the direction opposite to the direction of movement of the load 12. As seen in FIG. 4, a rotary brush member 65 is supported on arms 66 (only one seen in FIG. 4), and it is to be understood that the level of the brush 65 is the same as the elevation of the tail 60. As the load 12 moves rightwardly off the platform 16 as seen in FIG. 4, the brush member 65 is rotated in the clockwise sense as seen in plan (i.e., as seen in FIG. 4) and the bristles of the brush member 65 beat against the tail 60 and press it inwardly against the adjacent, stretched convolutions of the film 55.

Immediately downstream of the brush member 65 is hot air plenum 68 having a hot air nozzle 70 adapted to blow a stream of hot air directly against the side of the load at the same elevation as the tail 60, whereby to "shrivel" the tail to some extent and to cause it to stick to the adjacent, stretched convolution (which is identified by the numeral 71 in FIG. 3).

I claim:

1. In a wrapping apparatus for a palletized load having a rotatable platform for receiving the load, film-dispensing means adjacent the platform for receiving a roll of film of a width less than the height of the load, and means for rotating the platform while moving the film-dispensing means vertically in order to enwrap the load helically, the improvement which comprises:

an elongated member pivoted adjacent one end to the platform for swinging movement between first and second substantially horizontal positions through an arc of about 180° in a vertical plane substantially aligned with a side of the load, the member in said first position being below the level of the bottom of the load and bearing against a frictional surface supported by the platform, and in said second position being spaced away from said frictional surface and being also below the level of the bottom of the load, means for swinging the member from said second to said first positions to contact said film across substantially the full film width, to pull the film down below the level of the bottom of the load and to grip said film in said first position; and from said first to said second positions to release the gripped film and to take said elongated member below the level of the bottom of the load in order to keep said elongated member out of the path of subsequent film convolutions, and automatic severing means on the platform adjacent the frictional surface for severing film.

2. The invention claimed in claim 1, in which the member in said first position projects from its pivot location in the direction opposite the rotational direction of the platform.

3. The invention claimed in claim 2, in which the member in said second position projects in a direction substantially opposed to its first position direction.

4. The invention claimed in claim 1, in which said elongated member is a cylindrical roller mounted for free rotation about its axis.

5. The invention claimed in claim 1, in which the severing means is a resistance wire strung under tension, the wire being capable of being heated when an electrical current is passed therethrough, thereby to sever film by melting.

6. The invention claimed in claim 5, in which the member in said first position projects from its pivot location in the direction opposite the rotational direction of the platform, and in said second position projects in a direction substantially opposed to its first position direction; and in which said elongated member is a cylindrical roller mounted for free rotation about its axis.

7. A method of wrapping a palletized load on a wrapping apparatus having a rotatable platform for receiving the load, film dispensing means adjacent the platform for receiving a roll of film of a width less than the height of the load, and means for rotating the platform while moving the film-dispensing means vertically in order to enwrap the load helically, comprising the steps:

(a) providing an elongated member pivoted adjacent one end to the platform for swinging movement adjacent a side of the load, (b) providing a substantially horizontal frictional surface on the platform below the level of the bottom of the load, against which the elongated member in one position can bear, (c) providing automatic film-severing means on the platform adjacent the frictional surface, (d) gripping an end of the film between the elongated member and the frictional surface, (e) rotating the platform while simultaneously moving the film-dispensing means vertically upwardly and then downwardly through at least one up and down cycle, thereby to enwrap the load helically, and during said at least one cycle swinging the elongated member through an arc of about 180° in the vertical plane away from said frictional surface to a position below the level of the bottom of the load to take said elongated member out of the path of subsequent film convolutions, (f) halting the rotation of the platform when the film-dispensing means is substantially at the bottom of its movement and with the said side of the load toward the film-dispensing means, (g) and swinging the elongated member back through its vertical arc toward the frictional surface, thereby catching the portion of the film extending between the film-dispensing means and the load, pulling it down below the level of the bottom of the load, and entrapping it between the elongated member and the frictional surface, and (h) severing the film with severing means located on the platform adjacent the frictional surface, the severing being on the load side of the gripping location.

8. The method claimed in claim 7, in which the recited steps are followed by:

(i) replacing the said load with an unwrapped load, and then repeating steps (e) to (h).

9. The method claimed in claim 7, in which the severing means is a resistance wire strung under tension adjacent the frictional surface, and in which the step of severing is carried out by passing an electric current through the wire while the film is held against the wire by the grip between the elongated member and the frictional surface.

10. The method claimed in claim 7, in which the elongated member is a cylindrical roller mounted for free rotation about its axis.

* * * * *